United States Patent [19]

Kraemer et al.

[11] Patent Number: 5,018,732

[45] Date of Patent: May 28, 1991

[54] HAND HELD PADDLE STRUCTURE

[76] Inventors: Sandy F. Kraemer; Tyler D. Kraemer, both of 2402 Ceresa La., Colorado Springs, Colo. 80909

[21] Appl. No.: 351,666

[22] Filed: May 15, 1989

[51] Int. Cl.[5] ..... A63B 59/00

[52] U.S. Cl. ..... 273/67 B; 273/411

[58] Field of Search ..... 273/67 R, 67 B, 330, 273/414, 329, 75, 73 J, 76

[56] References Cited

U.S. PATENT DOCUMENTS 4,676,505 6/1987 Rodriguez et al. ..... 273/67 B 4,757,996 7/1988 McNutt et al. ..... 273/67 R

*Primary Examiner*—Edward M. Coven

*Assistant Examiner*—Sebastiano Passaniti

*Attorney, Agent, or Firm*—Phillip A. Rein

[57] ABSTRACT

This invention relates to a hand held paddle structure utilized with a ball member with one or more game players in an active game of skill. The hand held paddle structure includes a main support and grasp assembly having an impact paddle assembly connected thereto. The main support and grasp assembly includes a pair of spaced main support posts interconnected by an intermediate grasp bar. One of the support posts is provided with a curved thumb portion and/or a ridge portion to receive a thumb member of the game player therein to achieve the maximum amount of control and movement on grasping of the intermediate grasp bar by a game player. The intermediate grasp bar is provided with an arcuate ball support section to receive a ball member therein for storage purposes. The impact paddle assembly is provided with one and perhaps two parallel paddle plates adapted to contact and strike the ball member thereagainst in a method of game play.

15 Claims, 3 Drawing Sheets

HAND HELD PADDLE STRUCTURE

The other patent references are not deemed pertinent to the invention set forth herein.

PREFERRED EMBODIMENT OF THE INVENTION

In one preferred embodiment of this invention, a hand held paddle structure is utilized by one or more game players with a ball member whereupon the ball member can be utilized by one player as a game of skill or in a competitive game between two or more game players. The hand held paddle structure includes (1) a main support and grasp assembly; and (2) an impact paddle assembly secured to the main support and grasp assembly. The main support and grasp assembly includes a pair of spaced main support posts interconnected by an intermediate grasp bar. Each main support post includes a first support section integral with a second support section. One of the main support posts has the second support section provided with a thumb support section having a curved thumb portion and a ridge portion adjacent to the curved thumb portion. The intermediate grasp bar is provided with a main body section having an arcuate ball support section to receive and store a ball member between the arcuate ball support section and a portion of the impact paddle assembly. The impact paddle assembly includes a first paddle plate and a second paddle plate which are substantially identical. The first and second paddle plates are each provided with a main body having (1) an outer playing surface; (2) a peripheral edge section; and (3) an inner support surface. The outer playing surface is operable to receive and impact the ball member thereagainst in a method of play as will be described.

OBJECTS OF THE INVENTION

One object of this invention is to provide a hand held paddle structure having a main support and grasp assembly, an impact paddle assembly with a paddle plate mounted on each side of the main support and grasp assembly, and operable to be grasped by a game player and impact a ball member with either one of the paddle plates.

One further object of this invention is to provide a hand held paddle structure including a main support and grasp assembly with a unique curved thumb portion thereon and an intermediate grasp bar whereupon a hand member of a game player is readily grasped with the finger members about the intermediate grasp bar and a thumb member placed within the curved thumb portion to provide for new and novel grasping and movement control necessary for impacting a ball member.

One other object of this invention is to provide a hand held paddle structure having a main support and grasp assembly with a ridge portion whereupon a thumb member is operable to contact the ridge portion to provide a new, novel, and unique control thereof by a game player in impacting a ball member.

Another object of this invention is to provide a hand held paddle structure including a main support and grasp assembly with an impact paddle assembly secured thereto and provided with a storage area for a ball member between the impact paddle assembly and the main support and grasp assembly.

Still, one further object of this invention is to provide hand held paddle structures which could be used by a plurality of game players on enclosed court areas spaced apart from each other with the game players propelling a ball member from one court area to the other to be received and returned by the respective game players in a predetermined method of game play.

Still, one other object of this invention is to provide a hand held paddle structure which is sturdy in construction; easy to be grasped and firmly held by a hand portion of a game player; economical to manufacture; and providing a new method of game play.

Various other objects, advantages, and features of the invention will become apparent to those skilled in the art from the following discussion, taken in conjunction with the accompanying drawings, in which:

FIGURES OF THE INVENTION

Figure 1:
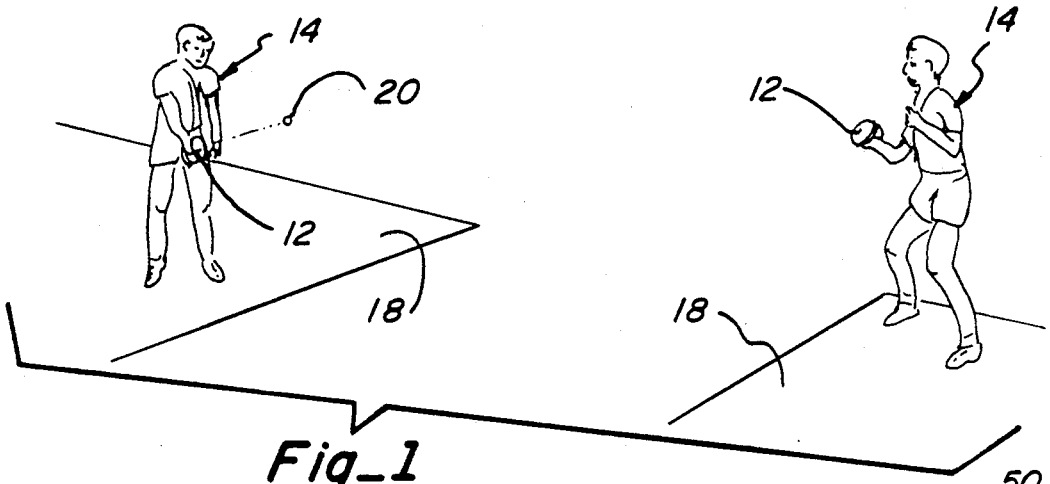
FIG. 1 is a perspective view illustrating a pair of game players each using a hand held paddle structure of this invention.

The following is a discussion and description of preferred specific embodiments of the hand held paddle structure of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a hand held paddle structure of this invention, indicated generally at 12, is illustrated as being grasped by respective game players 14 standing in spaced apart court areas 18 in order to impact and move a ball member 20 between the game players 14.

Figure 4:
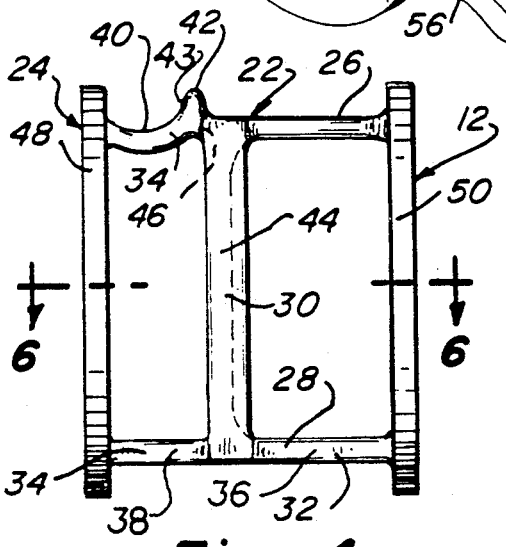
FIG. 4 is a side elevational view of the hand held paddle structure.
Figure 5:
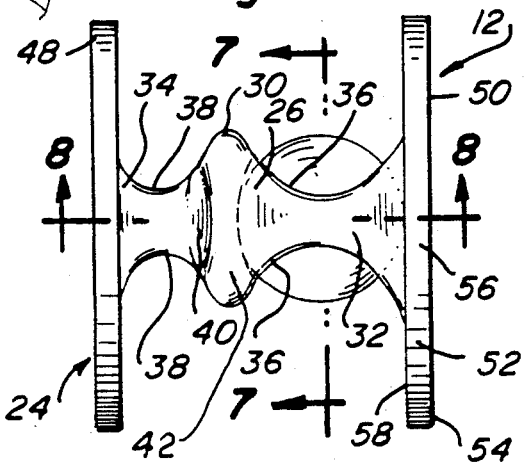
FIG. 5 is a top plan view of the hand held paddle structure illustrated with a ball member in a storage position.

As noted in FIG. 4, the hand held paddle structure 12 includes (1) a main support and grasping assembly 22; and (2) an impact paddle assembly 24 secured to the main support and grasping assembly 22. The main support and grasp assembly 22 includes a pair of spaced main support posts 26, 28 interconnected by an intermediate grasp bar 30.

The main support post 26 includes a first support section 32 integral with a second support section 34. The first support section 32 has arcuate opposed side portions 36. The second support section 34 includes (1) an arcuate side wall portion 38; and (2) a thumb support section 40 having a curved thumb portion 41 and an integral ridge portion 42.

The curved thumb portion 41 is formed with a reaction surface for controlled movement of the hand held paddle structure 12 as will be described.

The ridge portion 42 is formed with an upright reaction sided wall 43 for controlled movement of the hand held paddle structure 12 in a manner to be described.

The main support post 28 includes the first support section 32 integral with the second support section 34. The first support section 32 has the arcuate opposed side portions 36 and the second support section 34 is provided with the opposed arcuate side wall portion 38.

The intermediate grasp bar 30 includes a main body section 44 and having, on one side thereof, an arcuate ball support section 46 adapted to receive the ball member 20 therein for a storage function.

The impact paddle assembly 24 includes a pair of spaced, parallel, circular, ball striking elements being a first paddle plate 48 and a second paddle plate 50 which are identical and, therefore, only one needs to be described in detail. The first paddle plate 48 is provided with a main body 52. The main body 52 includes (1) an outer playing surface 54; (2) an integral peripheral edge section 56; and (3) an inner support surface 58.

It is noted that the impact paddle assembly 24 may use only the first paddle plate 48 with the second paddle plate 50 deleted from all the views. In fact, the paddle structure 12 presents a useable novel structure with the first paddle plate 48 connected to the main support post 26 which, in turn, is connected to the intermediate grasp bar 30.

Figure 6:
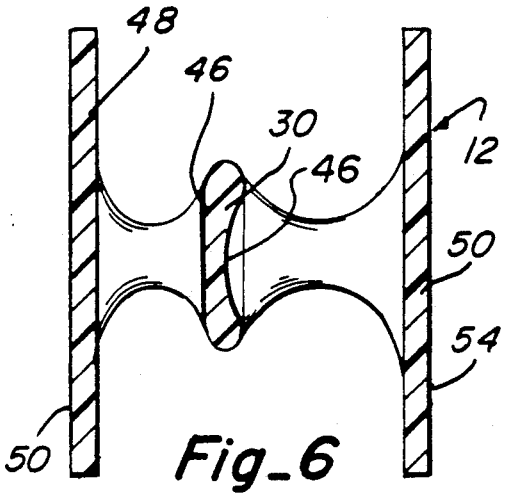
FIG. 6 is a sectional view taken along line 6—6 in FIG. 4.
Figure 7:
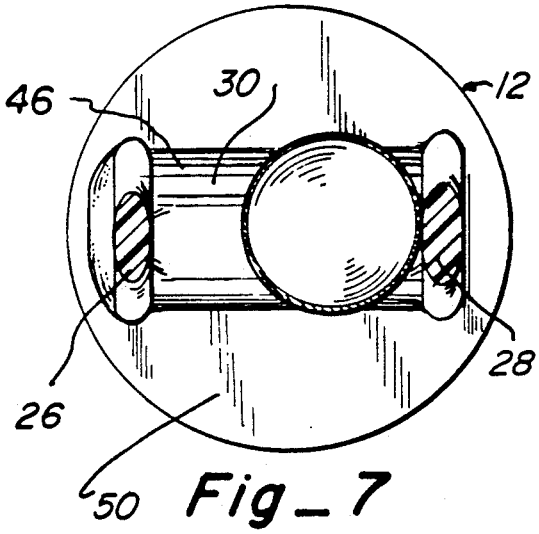
FIG. 7 is a sectional view taken along line 7—7 in FIG. 5.
Figure 8:
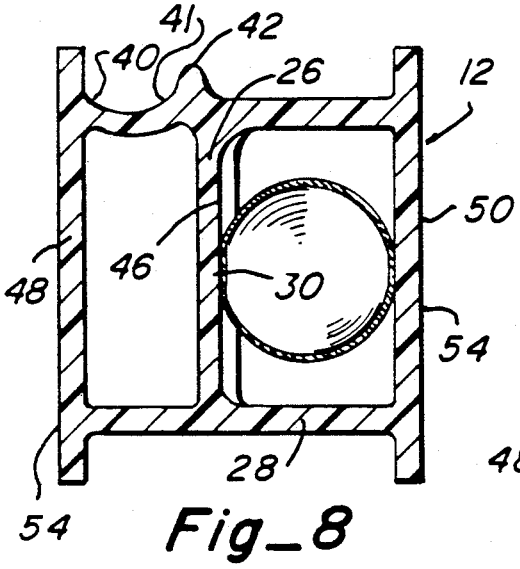
FIG. 8 is a sectional view taken along line 8—8 in FIG. 5.
Figure 10:
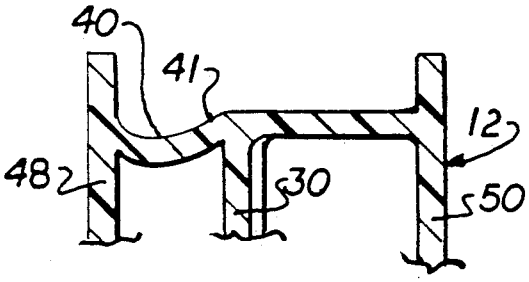
FIG. 10 is a fragmentary sectional view similar to FIG. 8 illustrating a second embodiment of the hand held paddle structure of this invention.
Figure 12:
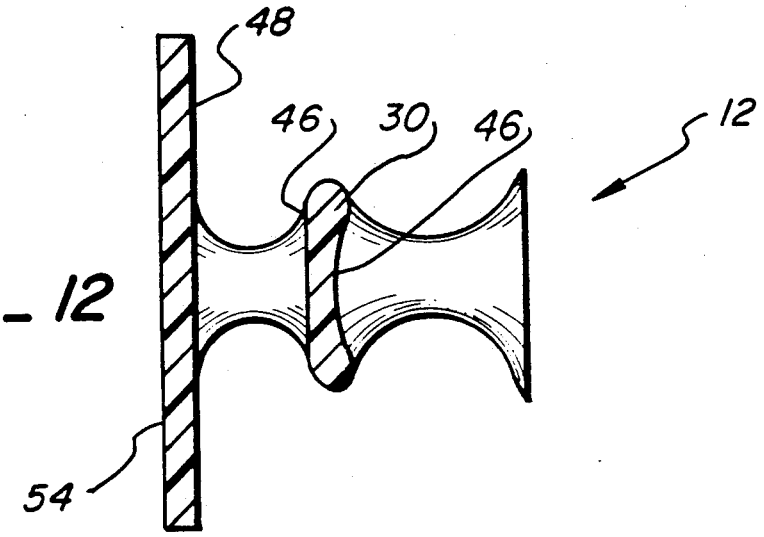
FIG. 12 is a sectional view similar to FIG. 6 except illustrating a hand held paddle structure of this invention utilizing a single paddle plate and a single main support post therewith.
Figure 13:
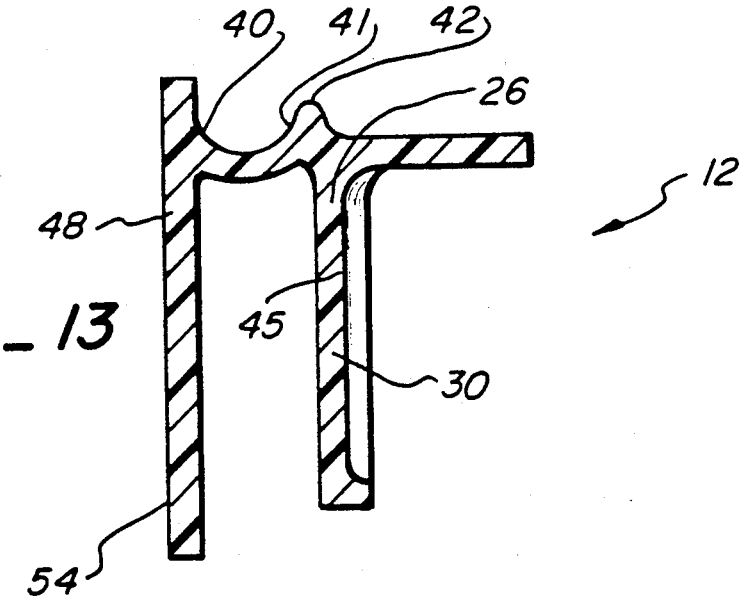
FIG. 13 is a sectional view similar to FIG. 8 illustrating the embodiment of FIG. 6 with a single paddle plate.
Figure 14:
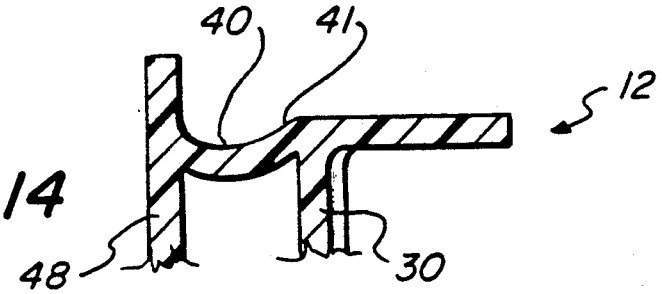
FIG. 14 is a fragmentary sectional view similar to FIG. 10 of the single paddle plate embodiment.

As noted in FIGS. 12–14, inclusive, another embodiment of the hand held paddle structure 12 is provided which is similar to FIGS. 6, 8, and 10, respectively, except the second paddle 50 and the main support post 28 have been removed. The elements noted in FIGS. 12–14 have been previously discussed in detail.

USE AND OPERATION OF THE INVENTION

Figure 2:
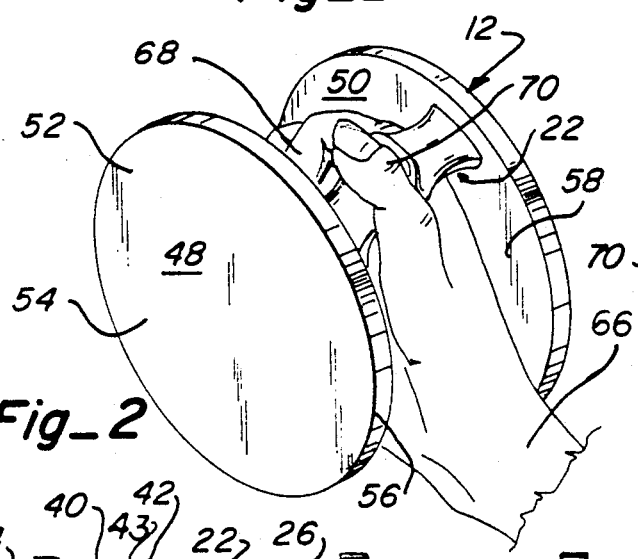
FIG. 2 is a perspective view of the hand held paddle structure of this invention as being grasped by a hand member of a game player.
Figure 3:
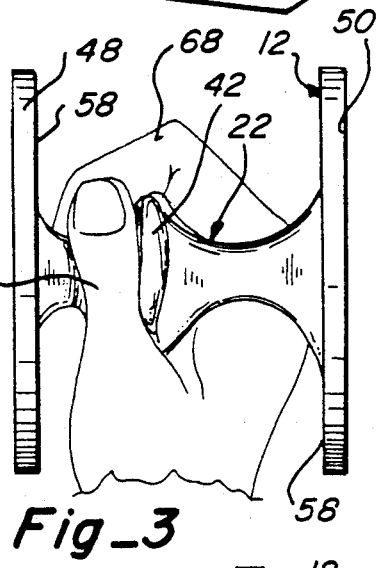
FIG. 3 is a view similar to FIG. 2 illustrating a top plan view thereof.

In the use and operation of the invention as noted in FIG. 1, the hand held paddle structure 12 is operable to be grasped in either a right or left hand member of a game player 14 and held in a compact firm manner as noted in FIGS. 2 and 3. Although the grasping of the hand held paddle structure 12 is illustrated in a right hand member 66 of the game player 14, it is obvious that the same can be readily grasped by a left hand member of the game player 14.

As noted in FIGS. 2 and 3, finger members 68 of the game player 14 are placed about and grasp the main body section 44 of the intermediate grasp bar 30. Knuckle portions of the finger members 68 are placed adjacent an inner support surface 58 of the second paddle plate 50 as it is spaced a greater distance from the intermediate grasp bar 30 than the first paddle plate 48. A thumb member 70 of the hand member 66 of the game player 14, is placed upon and within the curved thumb portion 41 and adjacent the ridge portion 42 of the second support section 34 of the main support post 26.

The curved thumb portion 41 of the thumb support section 40 and the reaction side wall 43 of the ridge portion 42 cooperate to receive the thumb member 70 thereagainst for secure grasping and controlled movement of the hand held paddle structure 12.

Figure 9:
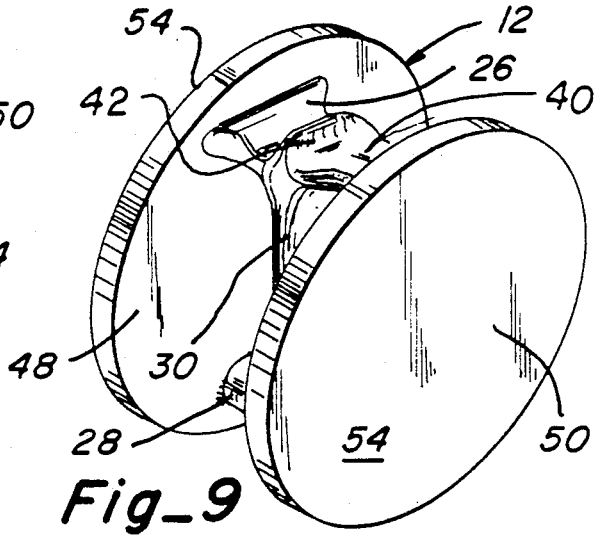
FIG. 9 is a perspective view of the hand held paddle structure of this invention.
Figure 11:
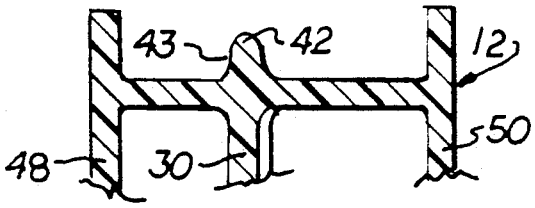
FIG. 11 is a fragmentary sectional view similar to FIG. 10 illustrating a third embodiment of the hand held paddle structure of this invention.

As noted in FIGS. 9, 10, and 11, the hand held paddle structure 12 can be constructed with either (1) the curved thumb portion 41; (2) the ridge portion 42; or (3) a combination of both the curved thumb portion 41 and the ridge portion 42. It has been found that the curved thumb portion 41 of the thumb support section 40 operates to provide for firm grasping of the intermediate grasp bar 30 so as to achieve the desired twisting movement thereof in all directions.

Additionally, it has been found that the curved thumb portion 41 can be eliminated and the substantial ridge portion 42 allows for grasping movement and leverage of the thumb member 70 against the reaction side wall 43 to achieve the desired controlled movement in all directions.

It is noted that the arcuate ball support section 46 is operable to receive and support the ball member 20 therein in the storage condition. This is an important feature of the invention to assure that the ball member 20 is always available for game play as conveyed with the hand held paddle structure 12 of this invention.

As noted in FIG. 1, the respective hand held paddle structures 12 can be held in the hand members 66 of the spaced apart game players 14 standing within the court areas 18. In one method of game play, the ball member 20 is hit between game players 14 who are counting the number of consecutive returns without a miss. Teams of games players 14 may play against other teams or against their prior scores. Another method of game play is where the game player 14 repetitiously hits the ball member 20 vertically thus keeping it in the air and counting the number of hits or score as an indication of skill level to be beaten by himself or another game player 14.

It is noted that the hand held paddle structure of this invention is compact in structure; easily held, grasped, and manipulated by a game player in one's hand; economical to manufacture; requires a substantial amount of athletic skill for proper use thereof; and develops hand, eye, and physical coordination of the game player utilizing same.

While the invention has been described in conjunction with specific preferred specific embodiments thereof, it will be understood this description is intended to illustrate and not to limit the scope of the invention, which is defined by the following claims:

We claim:

1. A paddle structure adapted to be held in a person's hand and to strike a ball comprising:

(a) a main support and grasp assembly having a first paddle plate secured thereto;

(b) said main support and grasp assembly including a main support post secured to said paddle plate and an intermediate grasp bar secured to said main support post;

(c) said main support post having a thumb section positioned adjacent said intermediate grasp bar;

(d) said thumb support section including an arcuate curved thumb portion integral with an upright ridge portion curved upwardly and outwardly at a position adjacent to and toward a longitudinal axis of said intermediate grasp bar as seen from a side elevational view, adapted to receive the thumb member of the person's hand thereagainst to achieve a controlled twisting movement of said paddle structure during usage thereof;

whereby finger members of a person's hand encircle said intermediate grasp bar and the thumb member of person's hand may engage said thumb support section achieve controlled movement of said first paddle plate to strike ball.

2. A paddle structure as described in claim 1, including:

(a) a second paddle plate member secured to said main support and grasp assembly spaced and extended parallel to said first paddle plate.

3. A paddle structure as described in claim 1, wherein:

(a) said main support post includes a first support section integral with a second support section is;

(b) said thumb support section mounted in said second support section is adjacent to and integral with said intermediate grasp bar and (c) said second support section extended perpendicular to said intermediate grasp bar.

4. A paddle structure as described in claim 1, wherein:

(a) said main support and grasp assembly includes another main support post secured to said first paddle plate and said intermediate grasp bar to add rigidity to said first paddle plate.

5. An paddle structure as described in claim 4, wherein:

(a) a second paddle plate extends parallel to said first paddle plate and secured to said main support post and said another main support post;

whereby said first and second paddle plates have outer parallel playing surfaces thereon to strike against the ball when utilizing said paddle structure.

6. A paddle structure as described in claim 1, wherein:

(a) said intermediate grasp bar has an arcuate ball support section operable to hold and store a ball between said arcuate ball support section and said first paddle plate.

7. A paddle structure as described in claim 1, wherein:

(a) said ridge portion is extended in axial alignment with said intermediate grasp bar.

8. A paddle structure adapted to be held in a person's hand and to strike a ball in a method of game play, comprising:

(a) a main support and grasp assembly having an impact paddle assembly secured thereto;

(b) said main support and grasp assembly including a pair of spaced main support posts interconnected by an intermediate grasp bar;

(c) said impact paddle assembly, including first and second parallel paddle plates interconnected by said main support posts;

(d) one of said main support posts including a support section having a thumb support section integral therewith and positioned adjacent said intermediate grasp bar; and (e) said thumb support section including an arcuate depressed thumb portion curved downwardly and inwardly at a position adjacent to and toward a longitudinal axis of said intermediate grasp bar as seen from a side elevational view to receive the thumb member of the person's hand and utilizing the same therein in cooperation with grasping said intermediate grasp bar for controlled movement of said paddle structure;

whereby finger members of a person's hand may encircle said intermediate grasp bar and the thumb member of the person's hand may engage said thumb support section to achieve controlled movement of said first and second paddle plates to strike a ball.

9. A paddle structure as described in claim 8, wherein:

a said thumb support section includes an upright ridge portion curved upwardly and outwardly at a position adjacent and toward said longitudinal axis of said intermediate grasp bar as seen from a side elevational view and operable to receive the thumb member of the person's hand utilizing said paddle structure thereagainst for controlled twisting movement thereof.

10. A paddle structure as described in claim 8, wherein:

(a) said intermediate grasp bar has a main body section formed with an arcuate ball support section;

whereby the ball is of a configuration to fit between said arcuate ball support section and one of said first second paddle plates for storage purposes.

11. A paddle structure as described in claim 8, wherein:

(a) said thumb support section including a curved thumb portion integral with an upright ridge portion having an upright reaction side wall positioned adjacent to and extended parallel and outwardly relative to said longitudinal axis of said intermediate grasp bar which cooperates to receive the thumb member of the person's hand thereagainst for controlled twisting movement of said paddle structure.

12. A paddle structure adapted to be held in a person's hand and to strike a ball, comprising:

(a) a main support and grasp assembly having a first paddle plate secured thereto;

(b) said main support and grasp assembly including a main support post secured to said paddle plate and an intermediate grasp bar secured to said main support post;

(c) said main support post having a thumb support section positioned adjacent said intermediate grasp bar;

(d) said thumb support section including an arcuate curved thumb portion integral with an upright ridge portion curved upwardly and outwardly at a position adjacent and toward a longitudinal axis of said intermediate grasp bar as seen from a side elevational view, adapted to receive the thumb member of the person's hand thereagainst to achieve a controlled twisting movement of said paddle structure during usage thereof; and (e) said thumb support section having an outer surface extended below and against an outer surface of said main support post;

whereby finger members of a person's hand may encircle said intermediate grasp bar and the thumb member of the person's hand may engage said thumb support section to achieve controlled movement of said first paddle plate to strike a ball.

13. A paddle structure as described in claim 12, wherein:

(a) said main support post includes a first support section integral with a second support section;

(b) said thumb support section is mounted in said second support section adjacent to and integral with said intermediate grasp bar;

(c) said second support section is extended perpendicular to said intermediate grasp bar; and (d) said outer surface on said second support section is extended above said outer surface of said thumb support section.

14. A paddle structure as described in claim 12, wherein:

(a) said main support and grasp assembly has another main support post secured to said first paddle plate and said intermediate grasp bar to add rigidity to said first paddle plate; and (b) a second paddle plate is extended parallel to said first paddle plate and to said main support plate and said another main support post.

15. A paddle structure adapted to be held in a person's hand and to strike a ball in a method of game play, comprising:

(a) a main support and grasp assembly having an impact paddle assembly secured thereto;

(b) said main support and grasp assembly including a pair of spaced main support posts interconnected by an intermediate grasp bar;

(c) said impact paddle assembly including first and second parallel paddle plates interconnected by said main support posts;

(d) one of said main support posts including support section having a thumb support section integral therewith and positioned adjacent said intermediate grasp bar;

(e) said thumb support section including an arcuate depressed thumb portion curved downwardly and inwardly at a position adjacent and toward a longitudinal axis of said intermediate grasp bar as seen from a side elevational view to receive the thumb member of the person's hand and utilizing the same therein in cooperation with grasping said intermediate grasp bar for controlled movement of said paddle structure; and (f) said second paddle plate is extended a distance greater from said intermediate grasp bar than said first paddle plate from said intermediate grasp bar whereupon the finger members of the person's hand is adapted to encircle said intermediate grasp bar and placed in the area between said first paddle member and said intermediate grasp bar for ease of grasping thereof.

whereby finger members of the person's hand may encircle said intermediate grasp bar and a thumb member of the person's hand may engage said thumb support section to achieve controlled movement of said first and second paddle plates to strike a ball.

* * * * *